US009863668B2

(12) United States Patent
Shin et al.

(10) Patent No.: US 9,863,668 B2
(45) Date of Patent: Jan. 9, 2018

(54) AIR CONDITIONER

(71) Applicant: LG ELECTRONICS INC., Seoul (KR)

(72) Inventors: Kwangho Shin, Seoul (KR); Hojong Jeong, Seoul (KR); Minho Chung, Seoul (KR); Song Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 168 days.

(21) Appl. No.: 14/993,693

(22) Filed: Jan. 12, 2016

(65) Prior Publication Data

US 2016/0201950 A1 Jul. 14, 2016

(30) Foreign Application Priority Data

Jan. 12, 2015 (KR) ..... 10-2015-0004178

(51) Int. Cl.

| | |
|---|---|
| ***F25B 6/02*** | (2006.01) |
| ***F24F 1/08*** | (2011.01) |
| ***F25B 13/00*** | (2006.01) |
| ***F24F 1/00*** | (2011.01) |

(52) U.S. Cl.

CPC ..... *F25B 6/02* (2013.01); *F24F 1/0007* (2013.01); *F24F 1/08* (2013.01); *F25B 13/00* (2013.01); *F25B 2327/00* (2013.01); *F25B 2327/001* (2013.01)

(58) Field of Classification Search

CPC ..... F24F 1/08; F25B 6/02; F25B 2327/00; F25B 2327/001

See application file for complete search history.

(56) References Cited

U.S. PATENT DOCUMENTS

| | | | |
|---|---|---|---|
| 2008/0034777 | A1 | 2/2008 | Copeland et al. |
| 2014/0360222 | A1 | 12/2014 | Masui |

FOREIGN PATENT DOCUMENTS

| | | |
|---|---|---|
| EP | 1 202 005 | 5/2002 |
| EP | 1 288 592 | 3/2003 |
| EP | 1 628 094 | 2/2006 |
| EP | 1 882 890 | 1/2008 |
| EP | 1 882 891 | 1/2008 |

(Continued)

OTHER PUBLICATIONS

Korean Office Action dated Dec. 4, 2015 issued in Application No. 10-2015-0004180.

(Continued)

*Primary Examiner* — Emmanuel Duke

(74) *Attorney, Agent, or Firm* — KED & Associates, LLP

(57) ABSTRACT

An air conditioner is provided. The air conditioner may include at least one indoor device, an electric heat pump (EHP) outdoor device connected with the at least one indoor device, and having a first compressor driven using electric power and a first outdoor heat exchanger, and a gas heat pump (GHP) outdoor device connected with the at least one indoor device, and having an engine portion driven through a combustion gas, a second compressor driven by receiving a driving force from the engine portion, and a second outdoor heat exchanger. The GHP outdoor device may include an engine circulation pipe in which a refrigerant flowing through the EHP outdoor device may be introduced and then supplied to the engine portion.

20 Claims, 3 Drawing Sheets

(56) References Cited

FOREIGN PATENT DOCUMENTS

| | | | | |
|---|---|---|---|---|
| JP | 07-332815 | | | 12/1995 |
| JP | 08-254371 | | | 10/1996 |
| JP | 11-315719 | A | | 11/1999 |
| JP | 2000-097515 | | | 4/2000 |
| JP | 2002-130743 | | | 5/2002 |
| JP | 2002-168539 | | | 6/2002 |
| JP | 2003-021416 | | | 1/2003 |
| JP | 2003021416 | A | * | 1/2003 |
| JP | 2003-194384 | | | 7/2003 |
| JP | 2006494467 | | | 7/2006 |
| JP | 2007-225141 | | | 9/2007 |
| JP | 2007225141 | A | * | 9/2007 |
| JP | 2008-309383 | | | 12/2008 |
| JP | 2009-079813 | | | 4/2009 |
| JP | 2011-75162 | | | 4/2011 |
| JP | 2011075162 | A | * | 4/2011 |
| JP | 2012 007868 | | | 1/2012 |
| JP | 2014-092344 | | | 5/2014 |
| KR | 10-0199325 | | | 6/1999 |
| KR | 10-2004-0085540 | | | 10/2004 |
| KR | 10-2003-0077857 | A | | 5/2005 |
| KR | 10-2005-0043089 | A | | 5/2005 |
| KR | 10-2005-0112151 | | | 5/2006 |
| KR | 10-0575682 | | | 5/2006 |
| KR | 10-2007-0014952 | | | 2/2007 |
| KR | 10-0765563 | | | 10/2007 |
| KR | 10-2010-0002770 | | | 1/2010 |
| KR | 10-2010-0069188 | | | 6/2010 |
| KR | 10-2010-0129138 | | | 12/2010 |
| KR | 10-2014-0052339 | A | | 5/2014 |
| WO | WO 2014/065548 | | | 5/2014 |

OTHER PUBLICATIONS

Korean Office Action dated Jan. 4, 2016 issued in Application No. 10-2015-0004227.
European Search Report dated May 13, 2016 issued in Application No. 16150788.4.
Korean Notice of Allowance dated May 25, 2016 issued in Application No. 10-2015-0004227.
European Search Report dated May 25, 2016 issued in Application No. 15202910.4.
European Search Report dated Jun. 23, 2016 issued in Application No. 16150602.7.
Korean Office Action dated Jun. 28, 2016 issued in Application No. 10-2015-004178.
European Search Report dated May 31, 2016 issued in Application No. 16150596.1.
European Search Report dated May 31, 2016 issued in Application No. 16150600.1.
Korean Office Action dated Jul. 25, 2016 issued in Application No. 10-2015-0004275.
European Search Report dated Jun. 23, 2016 issued in Application No. 16150587.0.
Korean Notice of Allowance dated Jul. 26, 2016 issued in Application No. 10-2015-0004223.
Korean Office Action dated Aug. 12, 2016 issued in Application No. 10-2015-0004180.
Korean Office Action dated Nov. 27, 2015 issued in Application No. 10-2015-0004174.
Korean Notice of Allowance dated Dec. 26, 2016 issued in Application No. 10-2015-0004175.
Korean Notice of Allowance dated Dec. 26, 2016 issued in Application No. 10-2015-0004178.
Korean Notice of Allowance dated Jan. 10, 2017 issued in Application No. 10-2015-0004275.
U.S. Office Action dated Jul. 6, 2017 issued in co-pending U.S. Appl. No. 14/992,460.
U.S. Office Action dated Jul. 12, 2017 issued in co-pending U.S. Appl. No. 14/992,556.
U.S. Notice of Allowance dated Jul. 18, 2017 issued in co-pending U.S. Appl. No. 14/993,796.
U.S. Appl. No. 14/990,570, filed Jan. 7, 2016.
U.S. Appl. No. 14/991,135, filed Jan. 8, 2016.
U.S. Appl. No. 14/991,247, filed Jan. 8, 2016.
U.S. Appl. No. 14/992,460, filed Jan. 11, 2016.
U.S. Appl. No. 14/992,556, filed Jan. 11, 2016.
U.S. Appl. No. 14/993,796, filed Jan. 12, 2016.

* cited by examiner

AIR CONDITIONER

CROSS-REFERENCE TO RELATED APPLICATION(S)

This application claims priority under 35 U.S.C. §119 to Korean Application No. 10-2015-0004178, filed in Korea on Jan. 12, 2015, whose entire disclosure is hereby incorporated by reference.

BACKGROUND

1. Field

An air conditioner is disclosed herein.

2. Background

An air conditioner is an apparatus that cools, warms, or purifies indoor air to provide a comfortable indoor environment for a user. The air conditioner may be classified as an electric heat pump (EHP) type, which uses electric power, and a gas heat pump (GHP) type, which uses a gas fuel, such as liquid petroleum gas (LPG) or liquefied natural gas (LNG), according to a power source for driving a compressor of an outdoor unit or device. In the GHP type, an engine is operated by burning the gas fuel, and thus, the compressor is driven.

In the EHP type air conditioner, the compressor may be easily controlled through control of a current. The compressor may be driven through the control of the current, even when external air has a low temperature, and thus, the compressor may be easily driven.

However, in the GHP type air conditioner, as the engine uses the gas fuel, such as LPG or LNG, to be driven, it is not possible to respond to a partial load. When the external air has a low temperature, such as in winter, for example, startability of the engine is low.

Korean Patent Publication No. 10-2005-0043089, which is hereby incorporated by reference, discloses a heat pump type air conditioner.

BRIEF DESCRIPTION OF THE DRAWINGS

Embodiments will be described in detail with reference to the following drawings in which like reference numerals refer to like elements, and wherein.

DETAILED DESCRIPTION

Figure 1:
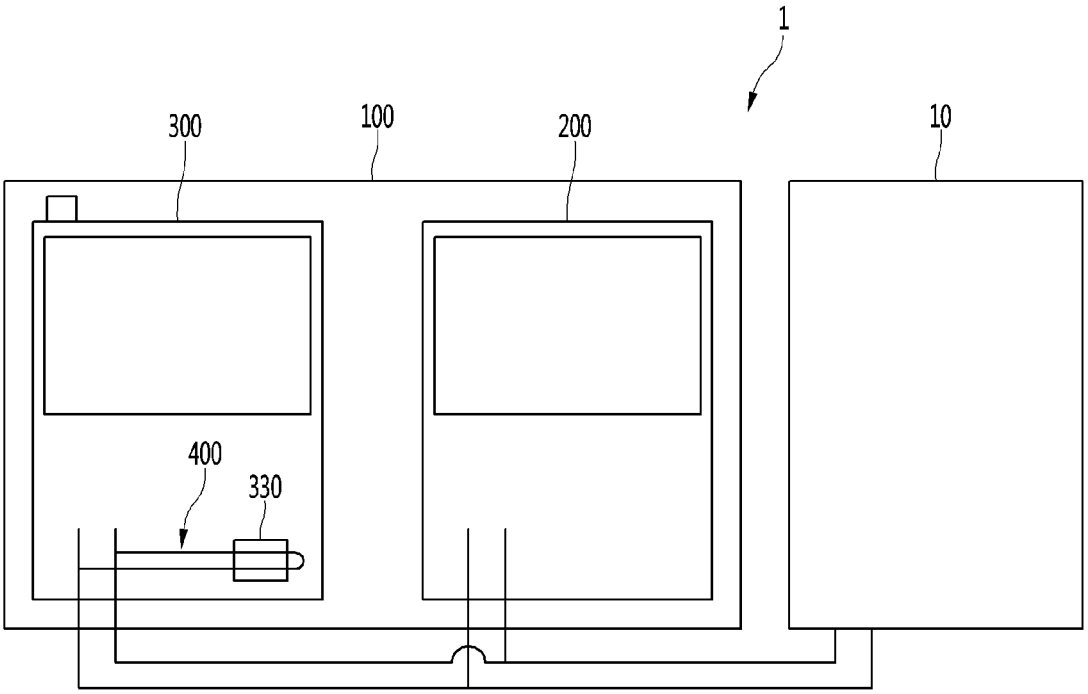
FIG. 1 is a schematic diagram of an air conditioner according to an embodiment.
Figure 2:
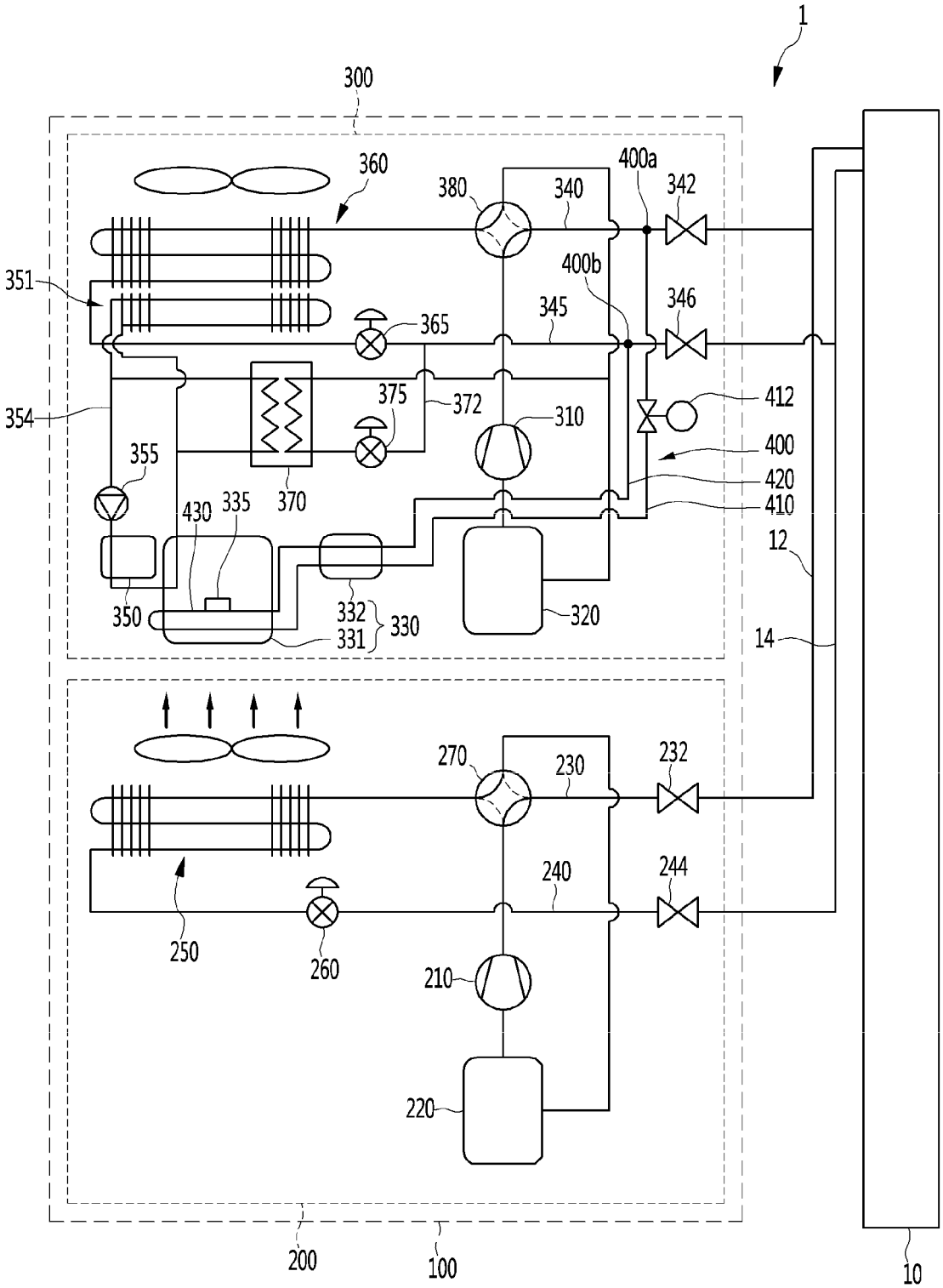
FIG. 2 is a detailed schematic diagram of the air conditioner of FIG. 1.

FIG. 1 is a schematic diagram of an air conditioner according to an embodiment. FIG. 2 is a detailed schematic diagram of the air conditioner of FIG. 1. Referring to FIGS. 1 and 2, an air conditioner 1 may include an indoor unit or device 10 and an outdoor unit or device 100.

One or more indoor device 10 may be provided. The one or more indoor device 10 may be connected to the outdoor device 100 and may cool, warm, or purify indoor air. The indoor device 10 may include a pair of pipes 12 and 14 that connects with the outdoor device 100. The pair of pipes 12 and 14 may include a gas pipe 12 that connects an electric heat pump (EHP) gas pipe 230 and a gas heat pump (GHP) gas pipe 340, which will be described hereinafter, and a liquid pipe 14 that connects an EHP liquid pipe 240 and a GHP liquid pipe 345, which will be described hereinafter.

The outdoor device 100 may be connected to the one or more indoor device 10 and may perform compressing and expanding, for example, of a refrigerant so as to sufficiently exchange heat. A plurality of outdoor devices 100 may be provided. Hereinafter, for convenience of explanation, an embodiment having one pair of outdoor devices 100 will be described.

The pair of outdoor devices 100 may include an EHP outdoor device 200, which forms an EHP, and a GHP outdoor device 300, which forms a GHP using a gas fuel, such as LPG or LNG. The EHP outdoor device 200 may be an outdoor device operated using an EHP method and may include a first compressor 210, a first accumulator 220, the EHP gas pipe 230, the EHP liquid pipe 240, a pair of connection valves 232 and 244, a first outdoor heat exchanger 250, a first outdoor heat exchanger control valve 260, and a first four-way valve 270. The first compressor 210 may compress the refrigerant and may be driven through applying of a voltage. That is, when the voltage is applied to the first compressor 210, the first compressor 210 may compress the refrigerant. As the first compressor 210 is driven by applying the voltage, the first compressor 210 may have less of an effect on external air, and it may be possible to respond to a partial load.

The first accumulator 220 may be installed or provided at a suction side of the first compressor 210 to supply the refrigerant to the first compressor 210. When the refrigerant flows backwards into the first compressor 210, or a liquid refrigerant is suctioned into the first compressor 210, the first compressor 210 may be damaged, and thus, the first accumulator 220 may temporarily store a mixture of oil and refrigerant.

The EHP gas pipe 230 may be installed or provided at a discharge side of the first compressor 210 and may connect the first compressor 210 with the indoor device 10. For example, the EHP gas pipe 230 may connect the first compressor 210 with the gas pipe 12. The EHP liquid pipe 240 may connect a side of the first outdoor heat exchanger 250 with the indoor device 10. For example, the EHP liquid pipe 240 may connect the first outdoor heat exchanger 250 with the liquid pipe 14. The pair of connection valves 232 and 244 may include a first connection valve 232, which may connect the EHP gas pipe 230 with the gas pipe 12, and a second connection valve 244, which may connect the EHP liquid pipe 240 with the liquid pipe 14.

The first outdoor heat exchanger 250 may evaporate or condense the refrigerant according to a warming operation or a cooling operation of the air conditioner 1. When the air conditioner 1 performs the cooling operation, the refrigerant may be condensed, and when air conditioner 1 performs the warming operation, the refrigerant may be evaporated. An outdoor fan that blows air may be installed or provided at a side of the first outdoor heat exchanger 250.

The first outdoor heat exchanger control valve 260 may control a flow of the refrigerant to the first outdoor heat exchanger 250. For example, the first outdoor heat exchanger control valve 260 may include an electronic expansion valve (EEV). An opening degree of the first outdoor heat exchanger control valve 260 may be controlled according to whether the air conditioner 1 performs the warming or cooling operation.

For example, when the air conditioner 1 performs the cooling operation, the refrigerant condensed in the first outdoor heat exchanger 250 may pass through the first outdoor heat exchanger control valve 260 and may flow toward the indoor device 10, and the opening degree of the first outdoor heat exchanger control valve 260 may be controlled so that the refrigerant is not decompressed. When the air conditioner 1 performs the warming operation, the refrigerant condensed in the indoor device 10 may pass through the first outdoor heat exchanger control valve 260 and may flow toward the first outdoor heat exchanger 250, and the opening degree of the first outdoor heat exchanger control valve 260 may be controlled so that the refrigerant is decompressed.

The first four-way valve 270 may switch a path of the refrigerant flowing in the EHP outdoor device 200. When the air conditioner 1 performs the cooling operation, the first four-way valve 270 may guide the refrigerant compressed in the first compressor 210 to the first outdoor heat exchanger 250. When the air conditioner 1 performs the warming operation, the first four-way valve 270 may guide the refrigerant compressed in the first compressor 210 to the indoor device 10. The EHP gas pipe 230 may be a discharge side pipe of the first compressor 210 and may extend to the first connection valve 232 via the first four-way valve 270.

The GHP outdoor device 300 may be an outdoor device operated using a GHP method and may include a second compressor 310, a second accumulator 320, an engine part or portion 330, the GHP gas pipe 340, the GHP liquid pipe 345, a pair of connection valves 342 and 346, a cooling water heat exchanger 350, a cooling water pump 355, a second outdoor heat exchanger 360, a second outdoor heat exchanger control valve 365, a plate type heat exchanger 370, a plate type heat exchanger control valve 375, a second four-way valve 380, and an engine circulation pipe 400.

The GHP gas pipe 340 and the GHP liquid pipe 345 may be parts or portions of a refrigerant pipe provided at the GHP outdoor device 300. The GHP gas pipe 340 may connect a discharge side of the second compressor 310 with the indoor device 10, and the GHP liquid pipe 345 may connect the second outdoor heat exchanger 360 with the indoor device 10.

The second compressor 310 may compress the refrigerant and may be operated through driving of an engine 331 of the engine portion 330, which will be described hereinafter. When a driving force is transmitted to the second compressor 310 through the engine 331, the second compressor 310 may compress the refrigerant.

The second accumulator 320 may supply the refrigerant to the second compressor 310. When the refrigerant flows backwards into the second compressor 310 or the liquid refrigerant is suctioned into the second compressor 310, the second compressor 310 may be damaged, and thus, the second accumulator 320 may temporarily store a mixture of oil and refrigerant.

The engine portion 330 may include the engine 331 and a governor 332. The engine 331 may transmit the driving force to the second compressor 310 and may be operated through burning of gas fuel, such as LPG or LNG. The GHP outdoor device 300 may be operated in the GHP method by combustion gas through the engine portion 330.

The governor 332 may adjust an amount of the fuel supplied to the engine 331. The GHP outdoor device 300 may include an air supply and a fuel supply, which may supply a mixed fuel to the engine 331, and a mixer that mixes the air and the fuel.

The air supply may include an air filter that purifies the air. The fuel supply may include the governor 332, which may supply fuel having a predetermined pressure.

For example, the governor 332 may include a zero-governor that constantly supplies the fuel to the engine 331. The zero-governor may be a device that constantly controls an outlet pressure of the fuel, regardless of an inlet pressure or a flow rate of the fuel, and then supplies the fuel.

For example, the zero-governor may include a nozzle that decompresses a pressure of the fuel, a diaphragm, on which the pressure decompressed at the nozzle may act, and a valve, which may be opened or closed by an operation of the diaphragm. The air passed through the air filter and the fuel discharged from the zero-governor may be mixed in the mixer, and mixed fuel may be supplied to the engine 331.

The engine circulation pipe 400 may be connected with the engine portion 330 and may heat the engine portion 330 using the refrigerant discharged from the first compressor 210 of the EHP outdoor device 200. That is, the engine circulation pipe 400 may circulate the refrigerant discharged from the first compressor 210 of the EHP outdoor device 200 to the engine portion 330, and then may transfer the refrigerant to the EHP outdoor device 200 again.

The engine circulation pipe 400 may be provided in contact with or close to an outer surface of the engine 331 to supply heat thereto. For example, the engine circulation pipe 400 may be connected with an oil pan 335 that stores engine oil of the engine 331 and may heat the engine oil stored in the oil pan 335. For example, the engine circulation pipe 400 may be installed or provided to be in contact with or close to the oil pan 335. Also, the engine circulation pipe 400 may be connected with the governor 332 so as to supply heat to the governor 332 and may heat the fuel passing through the governor 332.

The engine circulation pipe 400 may include a first end 400*a*, which may be coupled to the GHP gas pipe 340, and a second end 400*b*, which may be coupled to the GHP liquid pipe 345. That is, the engine circulation pipe 400 may extend from the GHP gas pipe 340 at the first end 40*a* and pass through the engine portion 330, and the second end 400*b* may be coupled to the GHP liquid pipe 345. The first end 400*a* may correspond to a point of the GHP gas pipe 340 at which the engine circulation pipe 400 is connected, and the second end 400*b* may correspond to a point of or on the GHP liquid pipe 345 at which the engine circulation pipe 400 is connected.

The engine circulation pipe 400 may include a first circulation pipe 410, a second circulation pipe 420, and a third circulation pipe 430. The first circulation pipe 410 may be connected to the GHP gas pipe 340 and may extend to a side of the engine portion 330. The first circulation pipe 410 may include the first end 400*a*. The second circulation pipe 420 may be connected to the GHP liquid pipe 345 and may extend to another side of the engine portion 330. The second circulation pipe 420 may include the second end 400*b*.

The third circulation pipe 430 may be connected to the first and second circulation pipes 410 and 420. For example, ends of the third circulation pipe 430 may be connected to the first circulation pipe 410 and the second circulation pipe 420. The third circulation pipe 430 may be connected to the engine portion 330. The third circulation pipe 430 may be provided in contact with or close to the engine 331 and the governor 332. The third circulation pipe 430 may provide heat of the refrigerant compressed in the first compressor 210 to the engine 331 and the governor 332.

Figure 3:
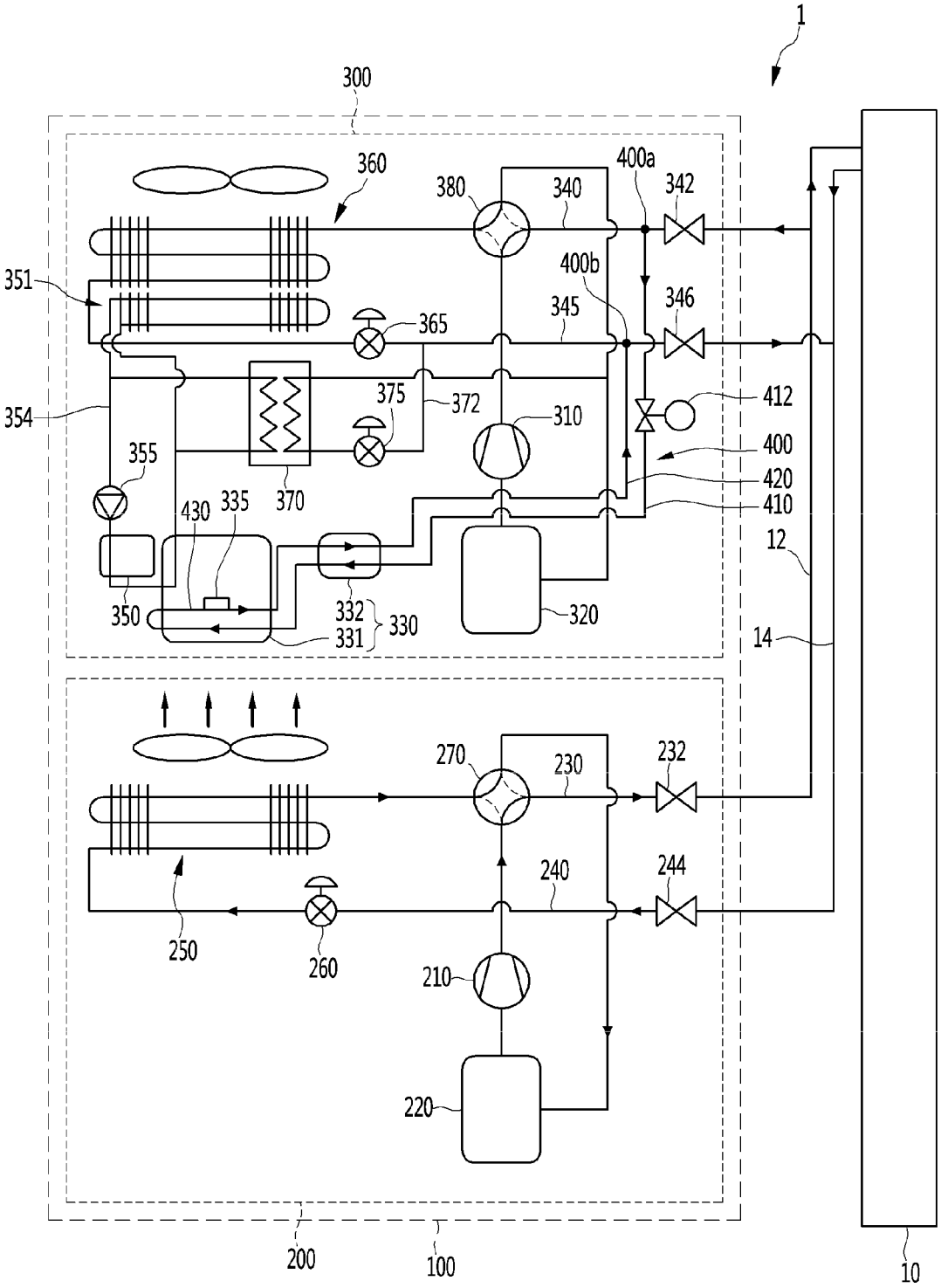
FIG. 3 is a schematic diagram illustrating an operation of the air conditioner of FIG. 2.

A circulation control valve 412, which may control a supply amount or a flow rate of the refrigerant introduced from the first compressor 210 of the EHP outdoor device 200, may be provided at the first circulation pipe 410 or the second circulation pipe 420. FIGS. 2 and 3 show the circulation control valve 412 provided at the first circulation pipe 410. However, the circulation control valve 412 may be installed or provided at the second circulation pipe 420. The circulation control valve 412 may include an EEV, which may control an opening degree, or a solenoid valve, which may be turned on or off.

The GHP gas pipe 340 may connect with the indoor device 10. The GHP gas pipe 340 may connect the second compressor 310 with the gas pipe 12. That is, the GHP gas pipe 340 may extend from a discharge side of the second compressor 310 to the gas pipe 12. The GHP liquid pipe 345 may connect with the indoor device 10. The GHP liquid pipe 345 may connect the second outdoor heat exchanger 360 with the liquid pipe 14. The pair of connection valves 342 and 346 may include a third connection valve 342, which may connect the GHP gas pipe 340 with the gas pipe 12, and a fourth connection valve 346, which may connect the GHP liquid pipe 345 with the liquid pipe 14.

The cooling water heat exchanger 350 may be provided at a side of the engine 331 to cool the engine 331. The cooling water heat exchanger 350 may absorb heat of or from the engine 331, which may be overheated due to the driving of the engine 331, using cooling water.

The GHP outdoor device 300 may further include a cooling water pipe 354 that guides a flow of cooling water for cooling the engine 331. The cooling water pipe 354 may be connected with the cooling water heat exchanger 350.

The cooling water pump 355, which may generate a flowing force of the cooling water, and a radiator 351, which may cool the cooling water, may be installed or provided at the cooling water pipe 354. The radiator 351 may be provided at a side of the second outdoor heat exchanger 360, and the cooling water flowing through the radiator 351 may exchange heat with external air by driving of an outdoor fan 360*a*, and thus, may be cooled. The cooling water passed through the cooling water pump 355 may pass through the cooling water pipe 354, and may be supplied to the cooling water heat exchanger 350.

The second outdoor heat exchanger 360 may evaporate or condense the refrigerant according to the warming operation and the cooling operation of the air conditioner 1. When the air conditioner 1 performs the cooling operation, the refrigerant may be condensed, and when the air conditioner 1 performs the warming operation, the refrigerant may be evaporated. The outdoor fan 360*a* that blows the external air may be installed or provided at a side of the second outdoor heat exchanger 360.

The second outdoor heat exchanger control valve 365 may control a flow of the refrigerant to the second outdoor heat exchanger 360, and may be provided at the GHP liquid pipe 345. As the second outdoor heat exchanger control valve 365 is similar to the first outdoor heat exchanger control valve 260, detailed description thereof has been omitted.

The plate type heat exchanger 370 may be a heat exchanger in which a low pressure refrigerant may exchange heat with high temperature cooling water. The cooling water may be cooled while exchanging heat in a plate type heat exchanger 370, and the refrigerant may be evaporated in this process.

The plate type heat exchanger control valve 375 may be provided at a connection pipe 372 of the plate type heat exchanger 370 and may control a flow of the refrigerant to the plate type heat exchanger 370. The connection pipe 372 of the plate type heat exchanger 370 may branch from the GHP liquid pipe 345 and may extend to the plate type heat exchanger 370. The plate type heat exchanger control valve 375 may be installed or provided parallel with the second outdoor heat exchanger control valve 365.

The second four-way valve 380 may switch a path of the refrigerant flowing in the GHP outdoor device 300. As the second four-way valve 380 is similar to the first four-way valve 270, detailed description thereof has been omitted.

FIG. 3 is a schematic diagram illustrating an operation of the air conditioner of FIG. 2. Referring to FIG. 3, when the GHP outdoor device 300 is unattended at a low temperature for a long period of time, the engine 331 may be cooled, the engine oil in the oil pan 335 provided at the engine 331 may also be cooled, and viscosity of the engine oil may increase. This may cause difficulties in starting of the engine 331 and may also cause an engine life of the engine 331 to be shortened or reduced.

When the GHP outdoor device 300 is unattended at a low temperature for a long period of time, the governor 332 and the gas fuel, such as LPG or LNG, may also be cooled, and an amount of the fuel supplied from the governor 332 to the engine 331 may be considerably reduced. In particular, LPG may not evaporate well at low temperatures. This phenomenon may also add to the problem of difficulty in starting the engine 331.

Therefore, when the GHP outdoor device 300 is unattended at a low temperature for a long period of time, first, the EHP outdoor device 200 may be driven, and the warming operation may be performed. In the GHP outdoor device 300, the third and fourth connection valves 346 may be opened.

More specifically, the refrigerant discharged from the first compressor 210 of the EHP outdoor device 200 may flow along the EHP gas pipe 230, the first connection valve 232 and the gas pipe 12. The first connection valve 232 may be opened so that the refrigerant compressed in the first compressor 210 may flow to the gas pipe 12. At least some of the refrigerant in the EHP outdoor device 200 that flows through the gas pipe 12 may be bypassed to the first circulation pipe 410 of the engine circulation pipe 400 through the third connection valve 342 and the GHP gas pipe 340 of the GHP outdoor device 300.

The circulation control valve 412 may be opened. An opening degree of the circulation control valve 412 may be controlled, and a supply amount or flow rate of the refrigerant compressed in and discharged from the first compressor 210 of the EHP outdoor device 200 may be appropriately controlled, according to the opening degree of the circulation control valve 412.

The refrigerant flowing through the first circulation pipe 410 may flow, in turn, along the third circulation pipe 430 and the second circulation pipe 420. In this process, the refrigerant may exchange heat with the engine 331 and the governor 332, for example, to supply heat to the engine 331 and the governor 332. That is, the refrigerant in the third circulation pipe 430, which may be provided in contact with or close to the engine 331 and the governor 332, may exchange heat with the engine 331 and the governor 332. Therefore, the refrigerant supplied from the EHP outdoor device 200 and circulated in the third circulation pipe 430 may provide heat to the engine 331 and the governor 332, and thus, may heat the engine oil of the engine 331 or may provide heat to the fuel passing through the engine 331 and the governor 332.

The refrigerant in the third circulation pipe 430 heat-exchanged with the engine portion 330 may be introduced again into the EHP outdoor device 200 through the second circulation pipe 420, the GHP liquid pipe 345 of the GHP outdoor device 300, the fourth connection valve 346 and the liquid pipe 14. The second connection valve 244 may be opened so that the refrigerant flowing through the liquid pipe 14 may flow to the first outdoor heat exchanger 250.

When the EHP outdoor device 200 performs the warming operation, the refrigerant compressed in and discharged from the first compressor 210 of the EHP outdoor device 200 may be supplied to the GHP outdoor device 300 through the engine circulation pipe 400, and thus, the frozen engine portion 330 of the GHP outdoor device 300 may be warmed. That is, in the air conditioner 1, the startability problem of the engine 331 may be solved by heating the engine portion 330 of the GHP outdoor device 300 using the discharged heat of the EHP outdoor device 200. Therefore, the air conditioner according to embodiments disclosed herein may enhance startability of the engine and may extend the engine life of the engine.

When the EHP outdoor device performs the warming operation, the refrigerant compressed in and discharged from the first compressor of the EHP outdoor device may be supplied to the GHP outdoor device through the engine circulation pipe, and thus, the frozen engine portion of the GHP outdoor device may be warmed. As the engine portion of the GHP outdoor device may be heated using the discharged heat of the EHP outdoor device, the startability problem of the engine may be solved.

An air conditioner according to embodiments disclosed herein which may have improved startability and high efficiency is provided.

Embodiments disclosed herein provide an air conditioner including at least one indoor unit or device; an electric heat pump (EHP) outdoor unit or device connected with the at least one indoor unit, and having a first compressor driven using electric power and a first outdoor heat exchanger; and a gas heat pump (GHP) outdoor unit or device connected with the at least one indoor unit, and having an engine part or portion driven by a combustion gas, a second compressor driven by receiving a driving force from the engine part, and a second outdoor heat exchanger. The GHP outdoor unit may include an engine circulation pipe, in which a refrigerant flowing through the EHP outdoor unit may be introduced and then supplied to the engine part.

The GHP outdoor unit may include a GHP gas pipe that connects a discharge side of the second compressor with the at least one indoor unit, and a GHP liquid pipe that connects the second outdoor heat exchanger with the at least one indoor unit, and the engine part circulation pipe may be coupled to the GHP gas pipe and the GHP liquid pipe. The engine part circulation part may include a first end, which may be coupled to the GHP gas pipe, and a second end, which may be coupled to the GHP liquid pipe.

The GHP outdoor unit may include a first circulation pipe, which may include the first end and extend from the GHP gas pipe to the engine part, and a second circulation pipe, which may include the second end and extend from the GHP liquid pipe to the engine part. The GHP outdoor unit may further include a third circulation pipe, which may be connected to the first circulation pipe and the second circulation pipe and may exchange heat with the engine part. The third circulation pipe may be installed or provided to be in contact with or close to the engine part.

The air conditioner may further include a circulation control valve, which may be installed or provided at the first circulation pipe or the second circulation pipe and may control a flow rate of the refrigerant supplied from the EHP outdoor unit.

The EHP outdoor unit may include an EHP gas pipe that connects a discharge side of the first compressor with the at least one indoor unit, and an EHP liquid pipe that connects the first outdoor heat exchanger with the at least one indoor unit. The air conditioner may further include an indoor unit gas pipe that connects the EHP gas pipe with the GHP gas pipe, and an indoor unit liquid pipe that connects the EHP liquid pipe with the GHP liquid pipe. The EHP outdoor unit may further include a first connection valve, which may be opened so that the refrigerant compressed in the first compressor may flow to the indoor unit gas pipe, and a second connection valve, which may be opened so that the refrigerant flowing through the indoor unit may flow to the first outdoor heat exchanger.

The GHP outdoor unit may further include a third connection valve, which may be opened so that at least some of the refrigerant flowing through the indoor unit gas pipe may flow to the GHP gas pipe and the engine part circulation pipe, and a fourth circulation valve, which may be opened so that the refrigerant flowing through the engine part circulation pipe may flow to the GHP liquid pipe and the indoor unit liquid pipe.

The engine part may include an engine that generates a driving force through burning of a fuel, and a governor that controls an amount of the fuel supplied to the engine. The governor may include a zero-governor that constantly controls an outlet pressure to constantly supply the fuel to the engine. The engine may further include an oil pan, in which engine oil may be accommodated, and the third circulation pipe may be connected to the oil pan. The third circulation pipe may be connected with the governor to heat the combustion gas.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner, comprising:

at least one indoor device;

an electric heat pump (EHP) outdoor device connected with the at least one indoor device, and having a first compressor driven using electric power and a first outdoor heat exchanger; and a gas heat pump (GHP) outdoor device connected with the at least one indoor device, and having an engine portion driven using a combustion gas, a second compressor driven by receiving a driving force from the engine portion, and a second outdoor heat exchanger, wherein the GHP outdoor device includes an engine circulation pipe in which a refrigerant flowing through the EHP outdoor device is introduced and then supplied to the engine portion.

2. The air conditioner according to claim 1, wherein the GHP outdoor device includes:

a GHP gas pipe that connects a discharge side of the second compressor with the at least one indoor device; and a GHP liquid pipe that connects the second outdoor heat exchanger with the at least one indoor device, wherein the engine circulation pipe is coupled to the GHP gas pipe and the GHP liquid pipe.

3. The air conditioner according to claim 2, wherein the engine circulation pipe includes a first end, which is coupled to the GHP gas pipe, and a second end, which is coupled to the GHP liquid pipe.

4. The air conditioner according to claim 3, wherein the GHP outdoor device includes:

a first circulation pipe that includes the first end and extends from the GHP gas pipe to the engine portion; and a second circulation pipe that includes the second end and extends from the GHP liquid pipe to the engine portion.

5. The air conditioner according to claim 4, wherein the GHP outdoor device further includes a third circulation pipe that is connected to the first circulation pipe and the second circulation pipe and exchanges heat with the engine portion.

6. The air conditioner according to claim 5, wherein the third circulation pipe is provided in contact with or close to the engine portion.

7. The air conditioner according to claim 5, wherein the engine portion includes:

an engine that generates the driving force through burning of a fuel; and a governor that controls an amount of the fuel supplied to the engine.

8. The air conditioner according to claim 7, wherein the governor includes a zero-governor that constantly controls an outlet pressure to constantly supply the fuel to the engine.

9. The air conditioner according to claim 8, wherein the third circulation pipe is connected with the governor to heat the combustion gas.

10. The air conditioner according to claim 7, wherein the engine further includes an oil pan, in which engine oil is accommodated, and the third circulation pipe is connected to the oil pan.

11. The air conditioner according to claim 4, further including a circulation control valve that is provided at or on the first circulation pipe or the second circulation pipe and controls a flow rate of the refrigerant supplied from the EHP outdoor device.

12. The air conditioner according to claim 2, wherein the EHP outdoor device includes:

an EHP gas pipe that connects a discharge side of the first compressor with the at least one indoor device; and an EHP liquid pipe that connects the first outdoor heat exchanger with the at least one indoor device.

13. The air conditioner according to claim 12, further including:

a gas pipe that connects the EHP gas pipe with the GHP gas pipe; and a liquid pipe that connects the EHP liquid pipe with the GHP liquid pipe.

14. The air conditioner according to claim 13, wherein the EHP outdoor device further includes:

a first connection valve, which is opened to allow refrigerant compressed in the first compressor to flow to the gas pipe; and a second connection valve, which is opened to allow refrigerant flowing through the at least one indoor device to flow to the first outdoor heat exchanger.

15. The air conditioner according to claim 13, wherein the GHP outdoor device further includes:

a third connection valve, which is opened to allow at least some of refrigerant flowing through the gas pipe to flow to the GHP gas pipe and the engine circulation pipe; and a fourth circulation valve, which is opened to allow refrigerant flowing through the engine circulation pipe to flow to the GHP liquid pipe and the liquid pipe.

16. An air conditioner, comprising:

at least one indoor device;

an electric heat pump (EHP) outdoor device, which communicates with the at least one indoor device, having a first compressor driven using electric power and a first outdoor heat exchanger; and a gas heat pump (GHP) outdoor device, which communicates with the at least one indoor device, including:

an engine portion using a combustion gas to drive a second compressor;

a second outdoor heat exchanger;

an engine circulation pipe that supplies a refrigerant from the EHP outdoor device to the engine portion;

a GHP gas pipe that connects a discharge side of the second compressor with the at least one indoor device; and a GHP liquid pipe that connects the second outdoor heat exchanger with the at least one indoor device, wherein the engine circulation pipe is coupled to the GHP gas pipe and the GHP liquid pipe.

17. The air conditioner according to claim 16, wherein the GHP outdoor device further includes:

a first circulation pipe that includes a first end that extends from the GHP gas pipe to the engine portion;

a second circulation pipe that includes a second end that extends from the GHP liquid pipe to the engine portion; and a circulation control valve provided at or on the first circulation pipe or the second circulation pipe to control a flow rate of the refrigerant supplied from the EHP outdoor device to the engine portion.

18. An air conditioner, comprising:

at least one indoor device;

an electric heat pump (EHP) outdoor device, which communicates with the at least one indoor device, including:

a first compressor driven using electric power;

a first outdoor heat exchanger;

an EHP gas pipe that connects a discharge side of the first compressor with the at least one indoor device; and an EHP liquid pipe that connects the first outdoor heat exchanger with the at least one indoor device; and a gas heat pump (GHP) outdoor device, which communicates with the at least one indoor device, including:

an engine portion using a combustion gas to drive a second compressor;

a second outdoor heat exchanger;

an engine circulation pipe that supplies a refrigerant from the EHP outdoor device to the engine portion;

a GHP gas pipe that connects a discharge side of the second compressor with the at least one indoor device; and a GHP liquid pipe that connects the second outdoor heat exchanger with the at least one indoor device.

19. The air conditioner according to claim 18, further including:

a gas pipe that connects the EHP gas pipe with the GHP gas pipe; and a liquid pipe that connects the EHP liquid pipe with the GHP liquid pipe.

20. The air conditioner according to claim 19, wherein the EHP outdoor device further includes:

a first connection valve, which is opened to allow refrigerant compressed in the first compressor to flow to the gas pipe; and a second connection valve, which is opened to allow refrigerant flowing through the at least one indoor device to flow to the first outdoor heat exchanger.

* * * * *